United States Patent [19]

McIntyre

[11] 4,443,491

[45] Apr. 17, 1984

[54] METHOD OF AND APPARATUS FOR PRODUCING ADHESIVE-COATED SHEET MATERIALS USABLE WITH RADIATION-CURED SILICONE RELEASE COATINGS AND THE LIKE

[75] Inventor: Frederic S. McIntyre, Wellesley, Mass.

[73] Assignee: Acumeter Laboratories, Inc., Marlborough, Mass.

[21] Appl. No.: 386,922

[22] Filed: Jun. 10, 1982

[51] Int. Cl.[3] ..... B05D 3/06

[52] U.S. Cl. ..... 427/44; 118/226; 427/208.4; 427/209

[58] Field of Search ..... 427/208.2, 208.4, 209, 427/44, 54.1; 118/226, 224

[56] References Cited

U.S. PATENT DOCUMENTS

| | | | |
|---|---|---|---|
| 2,406,057 | 8/1946 | Barrett et al. | 118/224 |
| 2,453,258 | 11/1948 | Pearson | 427/208.4 |
| 2,513,394 | 7/1950 | Barrett et al. | 118/224 |
| 2,631,946 | 3/1953 | Schueler | 118/224 |
| 2,645,199 | 7/1953 | Zonner | 118/224 |
| 3,087,850 | 4/1963 | Cole | 427/208.4 |
| 3,595,204 | 7/1971 | McIntyre et al. | 118/8 |
| 3,634,126 | 1/1972 | Cain et al. | 427/209 |
| 3,702,417 | 11/1972 | Bower et al. | 31/2 F |
| 3,745,396 | 7/1973 | Quintal et al. | 313/37 |
| 4,020,194 | 4/1977 | McIntyre et al. | 427/172 |
| 4,107,390 | 8/1978 | Gordon et al. | 427/44 |
| 4,133,939 | 1/1979 | Bokerman et al. | 427/54.1 |
| 4,151,319 | 4/1979 | Sackoff et al. | 427/208.4 |
| 4,201,808 | 5/1980 | Cully et al. | 427/54.1 |
| 4,241,198 | 12/1980 | Kobayashi | 427/208.4 |
| 4,277,301 | 4/1981 | McIntyre et al. | 156/446 |
| 4,288,479 | 9/1981 | Brack | 427/54.1 |

*Primary Examiner*—John H. Newsome
*Attorney, Agent, or Firm*—Rines and Rines

[57] ABSTRACT

A method and apparatus are disclosed for enabling integrated in-line synchronous hot-melt or similar adhesive coatings of web materials and simultaneously radiation-cured silicone coatings for use therewith, as for release purposes, through the use of coating and curing stations controlled with web speed and compatibly with the adhesive application and hardening steps.

18 Claims, 3 Drawing Figures

METHOD OF AND APPARATUS FOR PRODUCING ADHESIVE-COATED SHEET MATERIALS USABLE WITH RADIATION-CURED SILICONE RELEASE COATINGS AND THE LIKE

The present invention relates to methods of and apparatus for coating sheet material with hot or cold-melt adhesives and the like, and for enabling such sheet material to be rolled or otherwise stacked with the aid of intermediate radiation-cured silicone coatings which prevent adhesion of adjacent surfaces of the adhesive-coated layers on the sheet material.

Considering, for example, the area of coated tapes, in the current paper-converting industry, hot-melt coating is applied to a film or paper product which has been previously coated, as on the reverse side, with a silicone emulsion or solvent material. The practical difficulties of combining a solvent or an emulsion silicone coating system with a hot-melt coating line reside in the production speed limitations of the emulsion or solvent system, which are incompatible with the production speeds of hot-melt systems. The normal running speed of a solvent silicone system is approximately 150 feet per minute maximum; whereas, in contrast, the hot-melt system has capability of running at up to 1,000 feet per minute, more or less. Typical solvent or emulsion coater systems for applying silicone coatings are produced by, for example, Max Kroenert Maschinenfabrik (West Germany), Polytype (Switzerland), Faustal (Wisconsin, United States), and Bolton-Emerson (Massachusetts). Available hot-melt systems, have not had the capability of providing in-line silicone coatings, as well, particularly radiation-cured coatings of various weights and viscosities (UV-ultraviolet, or EB-electron beam cured coatings, for example). So long as the application of such different materials must be effected in multiple different steps or processes, and with separate apparatus, the costs of energy, of converting, of equipment, of labor, etc. have been distinctly advantageous.

An object of the present invention, accordingly, is to provide a new and improved method of producing sheet material carrying an adhesive coating, as of hot (or cold) melt and the like, and adapted for in-line use with sheet material carrying radiation-cured silicone coatings for enabling release of the sheet material in stacking, such as rolling and the like, that obviates the multiple-step requirements of the prior art and avoids the disadvantages above stated.

A further object is to provide novel coating apparatus of the in-line type of more general utility as well.

Other and further objects will be explained hereinafter and are more particularly delineated in the appended claims.

In summary, from one of its important points of view, the invention embraces a method of producing sheet material carrying an adhesive coating on one surface and adapted for use with radiation-cured silicone coating for enabling release of the sheet material in in-line stacking. In one form, the silicone radiation-cured coating is provided on the other surface of the same sheet; the method comprising applying uncured silicone coating material to one surface of the sheet material synchronously as the sheet material travels in web form; radiation-curing said silicone coating during the travel of the web to provide a cross-linked release coating; turning the web over as it continues its travel to expose its other surface; synchronously applying hot melt or other adhesive to said other surface at the same web travel speed and hardening the same; and stacking the sheet as by rolling at the same travel speed such that the silicone coating prevents adhesion of adjacent adhesive-coated sides and enables ready release of the same. In other versions, the method of the invention embraces applying the radiation-cured silicone coating to a separate sheet and feeding the adhesive-coated and silicone coated sheets together at the same speed with the respective cured silicone and adhesive coatings in contact, and stacking the same together as by rolling. Preferred details and best mode embodiments are hereinafter presented.

The invention will now be described with reference to the accompanying drawings, FIG. 1 of which is a combined mechanical and block diagram in side elevation illustrating the invention in preferred from adapted to provide at least two types of products—namely, a product such as adhesive-coated tapes and the like produced by the left and center portions of the apparatus to develop the hardened adhesive on one surface and the radiation-cured silicone release coating on the opposite surface; and with the right-hand portion of the apparatus shown in FIG. 1 adapted for the production of articles such as labels and the like having the adhesive applied to one surface of one sheet and wound together with a radiation-cured silicone coating on a second sheet;

As used in this specification, the term "coating" or similar terms are intended generically to embrace continuous layers or patterned layers of various sorts, as are well known in the industry. Suitable and preferred hot melt and related adhesive dispensing and nozzle apparatus, as hereinafter described, are, for example, of the type described in U.S. Pat. Nos. 3,595,204, 4,020,194 and 4,277,301 of the Acumeter Laboratories, Inc., the assignee of the present application. A suitable electron beam or "curtain" (EB) radiation-curing apparatus that may be used with the in-line system of the present invention is that of Energy Sciences, Inc. as described for example in U.S. Pat. Nos. 3,702,417 and 3,745,396. Suitable ultra-violet (UV) radiation lamps and the like may be of the type made by CanRad Hanovia in New Brunswick, N.J., though appropriately modified to embody the improvements hereinafter as later described in connection with control of the UV radiation in accordance with the web speed. The term "silicone", while deliberately intended to embrace the various types of UV and EB and related radiation-curable silicones, is generically used herein to cover the wide range of formulations of this type—all being generically embraced within this term as used in the specification and claims.

Figure 1:
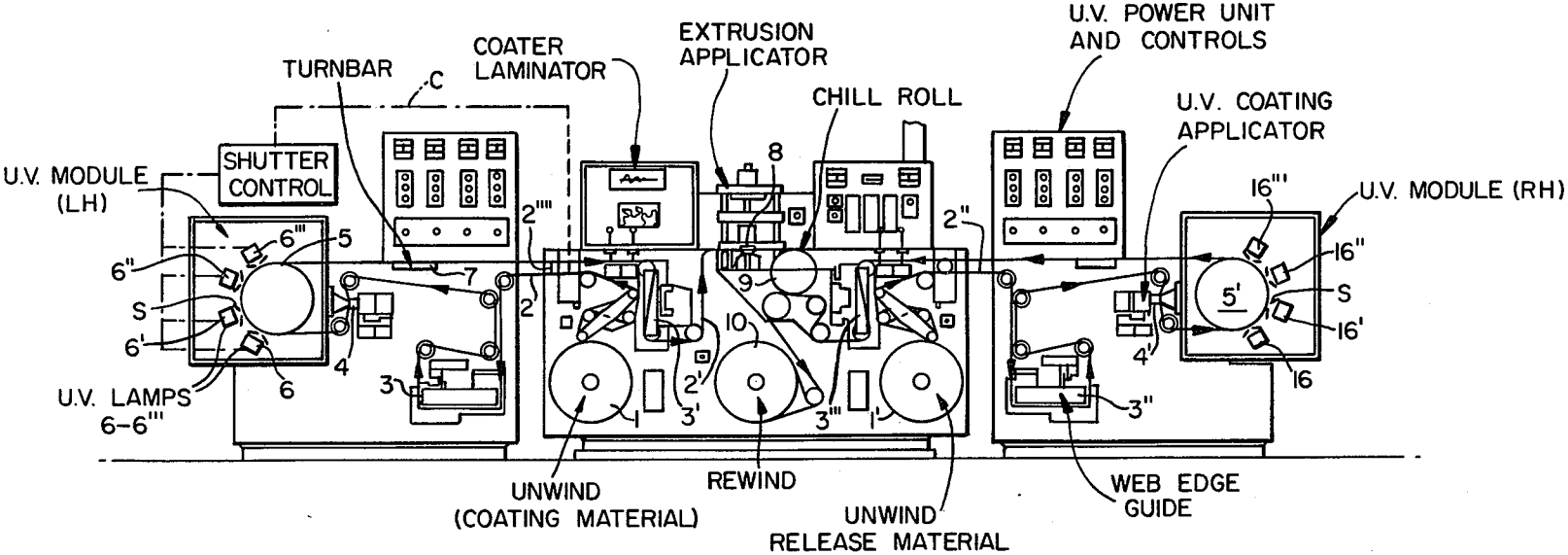

Referring to FIG. 1, the center module contains a pair of unwind mechanism 1 and 1', a center rewind 10, and a coating module 8 for hot melt. To the left- and right-hand sides of the center web module radiation-curable silicone coating and UV-curing stations are illustrated having edge guides which maintain web alignment either with a second web or coating stations, as desired. In FIG. 1 the unwind for the silicone coating (as for the making of pressure sensitive tape-type products, for example) passes the web from the center coating module section to the left-hand UV system. As it emerges at 2, the web passes on to an edge guide 3 and then into the UV-cured silicone coating module station 4 and then into a UV lamp drum chamber having successive lamps 6, 6', 6'', 6''' containing a rearward chill-roll 5. The purpose of the chill roll is to provide web integrity and position around or in front of the UV lamps and also to provide a heat sink to maintain thermal stability in the web, whether it be paper or plastic, as it winds past the arc of radiation lamps. The web with the cross-linked cured silicone release or other coating then passes from the UV module back into the center web module, continuing through an additional edge guide and then passing at the synchronous line speed through the hot-melt coating station 8. The hot melt coating is hardened by passage around another chill roll, thence becoming wound at line travel speed into a roll or other stack. As the cross-linked cured silicone-coated web exits from the UV curing chamber, the web (tape) material must be turned over by the turn bar 7 so as to apply the hot-melt adhesive onto the non-silicone coated side.

The system of FIG. 1 also enables the use of hot-melt or similar adhesive coated webs with additional webs of silicone or other coatings, again in a synchronous in-line integrated apparatus. For the making of label pressure-sensitive type materials, for example, containing two different web materials with adhesive and silicone coatings, the procedure in FIG. 1 is as follows. The left-hand UV module is not used in this situation, but the right-hand UV module is used together with the center module. The center module contains a label paper web on unwind 1 which passes at 2' through edge guide 3' to the coating station 8 with chill roll 9. At this point, unwind 1' delivers the web of uncoated silicone paper at 2'' into an edge guide 3'', entering the silicone coating station 4' and then the UV curing chamber with its arc of lamps 16 through 16'''. This web having the cured silicone coating now on its top side, passes out of the UV module and returns into the center coating web module through an edge guide 3''' and laminates at the chill roll 9 with the hot-melt adhesive-coated web previously described. The laminate web containing the two webs, respectively carrying contacting hardened hot melt adhesive and radiation-cured silicone is then immediately passed into a rewind roll or stack.

Figure 3:
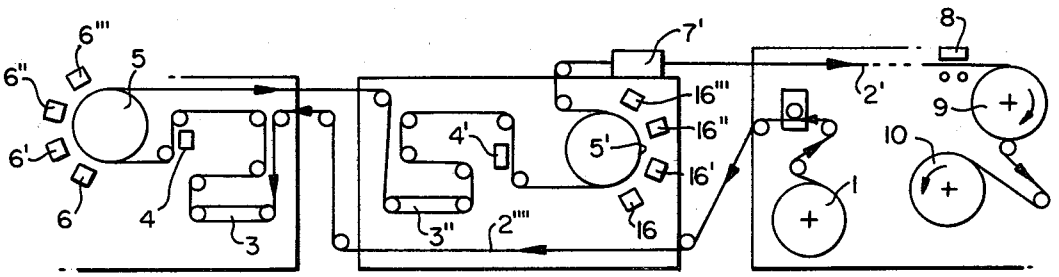
FIG. 3 is a diagram similar to part of FIG. 1 showing a modification in accordance with which a silicone-cured barrier coating is provided on the surface that is ultimately to receive the hot or cold melt adhesive coating.

As another example of the flexibility of this integrated apparatus, a barrier-coated product may be readily fabricated with a silicone coating as follows. Such a barrier coating may be desired, for example, to provide resistance to plasticizer migration that occurs with many hot-melt adhesives and which can eventually cause a deterioration in the final product. To overcome such undesirable results, a second UV coating and curing station adjacent to the first station is employed, as shown in FIG. 3. The center coating and web module is located to the extreme right in FIG. 3 with the web of tape material passing through an edge guide into the UV coating head and curing chamber 6 through 6''', with its backup chill roll 5. The web exits the UV module at its right side and then enters into the second UV module passing downward into an edge guide 3'' and then through the second UV coating station which is now designed for providing the barrier coating. With the barrier coating applied at 4', the web then passes into the UV curing chamber or tunnel with its lamps 16 through 16''' and then exits and passes over a turn-bar section 7' that reverses the web exposing the barrier coating directly to the in-line synchronous application of the hot-melt adhesive at 8. The adhesive is solidified at chill roll 9 and then enters into the rewind system 10.

Figure 2:
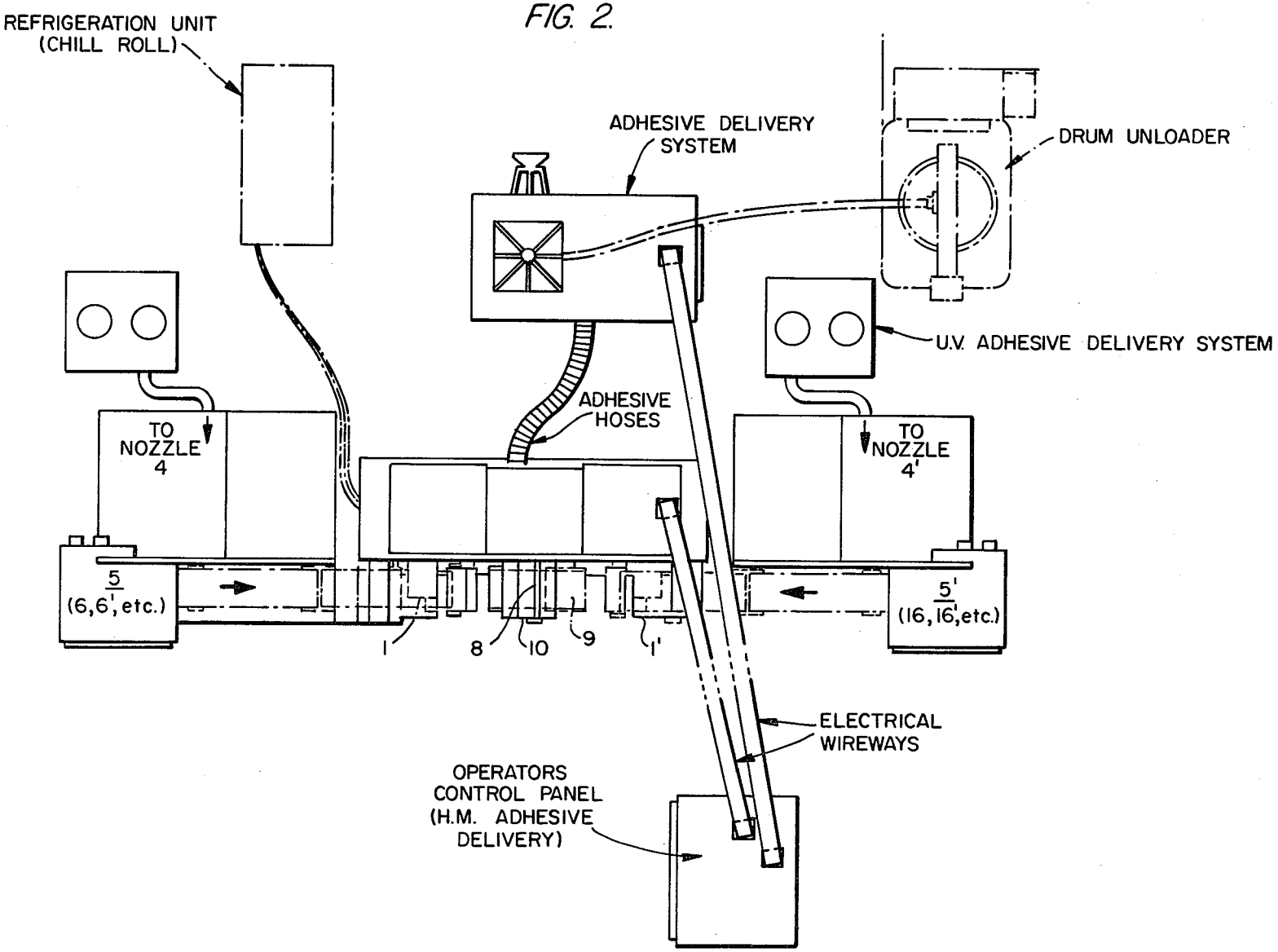
FIG. 2 is a top plan view of the system of FIG. 1.

Returning to further details of the integrated apparatus of FIG. 1, portions of which are also embodied in FIG. 3 as above explained, auxiliary parts are more clearly shown in the top view of FIG. 2. To the extreme left-hand side in the rear section are shown the silicone fluid delivery systems to be used, identified at 4. Directly behind the center web and coating module section is an adhesive system for the hot melt which delivers adhesive to coating station 8. And to the extreme right is a duplicate of the silicone delivery system for coating station 4'.

The integrated coating method and apparatus of the invention have the capability of producing packaging tapes encompassing plastic film materials, such as polypropylene and high-density polyethylene, and base paper products such as kraft papers, reinforced or otherwise, as well. Suitable adhesives for general purposes, as for use at room temperature or slightly above or below the same, include the HM1500 adhesives of L. W. Fuller, the P1585 of Malcolm Nichol Company, and Duractac 34 of National Adhesives. These products all use resins and plasticizers and copolymers and natural rubbers, including the product called Krayton of Shell Chemical of Houston, Tex. The silicone materials may be of the UV-curable type 7002 of Shinetsu of Japan or coatings of type G901 International Coatings Company of California preferably applied by nozzle equipment of the type described in said U.S. Pat. No. 3,595,204, in approximately 2 to 4 grams per square meter, depending upon the application. In test operation with the Acumeter Laboratories Model CL-306.5, one such equipment, operation at web speeds of 330 feet per minute with limited web widths of 7 inches was conducted. This apparatus contained a pair of UV lamps and the one hot-melt coating station, having all of the basic ingredients of the integrated system of FIGS. 1 and 2. Ultraviolet radiation curing was effected at a speed of between 50 feet per minute to 75 feet per minute with two mercury-filled UV lamps, operating at a 300 watt per inch of illuminated length.

In the preferred UV curing stations 6, etc. and 16, etc. of FIG. 1, four UV lamps or 300 watts per linear inch of illuminated length are used, each having shutters which are closed during down-time of the machine and thus prevent continued curing or over-curing of a coating while the web is at rest position. Upon start-up of web movement in the machine line, the successive shutters S on the four lamps will open to render the lamps effective at successive increased speed stages such as 0–50 feet per minute for the shutter of lamp 6 to open; 50–100 feet per minute, for the shutter of lamp 6' to open, and consecutively up through, for example, to 200 feet a minute for the shutter of lamp 6'''. In the reverse process, as the web system slows down, either by automatic command or by operator command, the shutter of lamp 6''' will close when it reaches its minimum speed bracket, and so on for the other lamps until the web has come to a complete rest. The objective of having shutters open and close at successive speed brackets is to provide a reasonable amount of curve without overcuring or without creating an undercured product as line speed is increased. While silicones can take considerable dosages of radiation, there are regions where the release properties are lost if the speed is too slow for the intense radiation—the control of radiation with web speed provided by the invention obviating such problems.

This shutter control is schematically shown effected by the control line C from the web-speed motor control to a shutter control solenoid device operating the successive shutters S of the UV or other radiation sources 6, 6′, 6″, 6‴, etc.

Further modifications will occur to those skilled in this art and all such are considered to fall within the spirit and scope of the invention as defined in the appended claims.

What is claimed is:

1. A method of producing sheet material carrying an adhesive coating on one surface and adapted for use with radiation-curved silicone for enabling release of the sheet material in stacking, that comprises, applying uncured silicone coating material to one surface of a sheet as the sheet travels continuously in web form; radiation-curing said silicone coating during travel of the web to provide a cross-linked release coating; controlling the degree of radiation-curing in accordance with the travel speed of the web to provide sufficient curing without overcuring; applying adhesive to one of (1) the other surface of said sheet and (2) a second sheet during travel of the web, and hardening the adhesive during travel of the web; and stacking, as by rolling at the travel speed of the web, by one of (1) winding the cured silicone coated and adhesive coated sheet and (2) winding the cured silicone-coated sheet with the adhesive-coated sheet and with the coatings in the contact.

2. A method as claimed in claim 1 and in which said radiation is selected from the group comprising UV and electron radiation.

3. A method of producing sheet material carrying an adhesive coating on one surface and a radiation-cured silicone coating on its other surface for enabling release of the sheet material in stacking, that comprises, applying uncured silicone coating material to one surface of sheet material as the sheet material travels continuously in web form; radiation-curing said silicone coating during the travel of the web to provide a cross-linked release coating; controlling the degree of radiation-curing in accordance with the travel speed of the web to provide sufficient curing without overcuring; turning the web over as it continues its travel to expose its other surface; applying adhesive to said other surface during travel of the web, and hardening the adhesive during travel of the web; and stacking the sheet as by rolling at the travel speed of the web such that the silicone coating prevents adhesion of adjacent adhesive-coated sides and enables ready release of the same.

4. A method as claimed in claim 3 and in which said radiation is from a plurality of UV sources, the number of sources rendered effective being varied in response to web travel speed to insure adequate curing without overcure.

5. A method as claimed in claim 3 and in which the said silicone coating is UV radiation cured and said sheet material is chilled from the said other surface during said UV radiation curing.

6. A method as claimed in claim 3 and in which, prior to said adhesive application, a barrier coating is applied to said other surface.

7. A method as claimed in claim 3 and in which said barrier coating is effected by applying the same and radiation-curing such coating before applying said adhesive thereupon.

8. A method as claimed in claim 3 and in which said radiation curing is effected by electron radiation.

9. A method as claimed in claim 3 and in which said adhesive is applied as a hot melt adhesive deposition and is thereafter chilled to harden.

10. A method of producing sheet material carrying an adhesive coating on one surface and adapted for use with radiation-cured silicone for enabling release of the sheet material in stacking, that comprises, applying uncured silicone coating material to one surface of one sheet as the sheet travels continuously in web form; radiation-curing said silicone coating during travel of the web to provide a cross-linked release coating; controlling the degree of radiation-curing in accordance with the travel speed of the web to provide sufficient curing without overcuring; applying adhesive to one surface of a second sheet traveling in web form continuously at the same speed as that of the said one sheet and hardening the adhesive during travel of said second sheet; feeding the said one and second sheets together at the same speed with their respective cured silicone and adhesive coatings in contact and stacking the same together as by rolling.

11. A method as claimed in claim 10 and in which said radiation curing is by UV radiation from a plurality of UV sources, the number of sources rendered effective being varied in response to web travel speed to insure adequate curing without overcure.

12. In a system for producing in-line adhesive and radiation-cured silicone coatings on sheet material, carried as a web continuously traveling at a predetermined but variable speed, apparatus having, in combination, means for applying uncured silicone coating at a first predetermined region of the sheet material web as the web travels; means following the applying means for radiation curing the silicone coating to provide a cross-linked release coating; means for controlling the degree of radiation curing in accordance with web travel speed; means for applying adhesive at a second predetermined region of sheet material as the web travels and for hardening the adhesive as the web travels; and means for continuously rolling the sheet material to stack the same with the cured silicone preventing adhesion of adhesive coatings and enabling release.

13. Apparatus as claimed in claim 2 and in which means is provided for turning the web having the cured silicone coating over to receive the adhesive coating on its opposite surface prior to travel of the sheet material to the adhesive applying means.

14. Apparatus as claimed in claim 12 and in which means is provided for passing separate sheets at the same web travel speed past the silicone coating and adhesive applying means, and said rolling means stacks the sheets with their respective cured silicone and hardened adhesive coatings in contact with each other.

15. Apparatus as claimed in claim 12 and in which said radiation is selected from the group comprising UV and electron radiation.

16. Apparatus as claimed in claim 12 and in which said radiation is produced by a plurality of UV lamps provided with means for shuttering successive lamps in accordance with web travel speed.

17. Apparatus as claimed in claim 12 and in which said system is constructed in modular form, said system comprising a first module including means for supplying said sheet material and including said adhesive applying and hardening means and said sheet material rolling means, and a second module including said silicone coating applying and curing means.

18. Apparatus as claimed in claim 14 and in which said system is constructed in modular form, said system comprising a first module including means for supplying said separate sheets and including said adhesive applying and hardening means and said rolling means, and a second module including said silicone coating applying and curing means.

* * * * *